US008710434B2

(12) United States Patent
Yoshioka et al.

(10) Patent No.: US 8,710,434 B2
(45) Date of Patent: Apr. 29, 2014

(54) MASS SPECTROMETRY DEVICE AND METHOD USING ION-MOLECULE REACTION IONIZATION

(75) Inventors: Shinji Yoshioka, Hitachinaka (JP); Kouhei Mochizuki, Hitachinaka (JP); Masaki Yoshie, Hitachinaka (JP)

(73) Assignee: Hitachi High-Technologies Corporation, Tokyo (JP)

( * ) Notice: Subject to any disclaimer, the term of this patent is extended or adjusted under 35 U.S.C. 154(b) by 0 days.

(21) Appl. No.: 13/522,351

(22) PCT Filed: Mar. 11, 2011

(86) PCT No.: PCT/JP2011/055795

§ 371 (c)(1),
(2), (4) Date: Jul. 16, 2012

(87) PCT Pub. No.: WO2011/115015

PCT Pub. Date: Sep. 22, 2011

(65) Prior Publication Data

US 2012/0326021 A1 Dec. 27, 2012

(30) Foreign Application Priority Data

Mar. 15, 2010 (JP) ..... 2010-057249

(51) Int. Cl.
*H01J 49/12* (2006.01)

(52) U.S. Cl.
USPC ..... 250/288; 250/282

(58) Field of Classification Search
USPC ..... 250/281, 282, 285, 288
See application file for complete search history.

(56) References Cited

U.S. PATENT DOCUMENTS 3,723,730 A * 3/1973 Gordon et al. ..... 250/298
2002/0175281 A1* 11/2002 Valaskovic ..... 250/288

(Continued)

FOREIGN PATENT DOCUMENTS

JP 64-35845 A 2/1989
JP 5-89822 A 4/1993

(Continued)

OTHER PUBLICATIONS

Corresponding International Search Report with English Translation dated Jun. 14, 2011 (five (5) pages).

(Continued)

*Primary Examiner* — Jack Berman
*Assistant Examiner* — David E Smith
(74) *Attorney, Agent, or Firm* — Crowell & Moring LLP

(57) ABSTRACT

A mass spectrometer that performs ion-molecule reaction ionization and accurately performs qualitative/quantitative analysis on a sample containing multi-components for a short time is achieved without an increase in the size of the device. A plurality of ion sources (3-1 to 3-4) are connected to each other in series. A controller/analyzer (6) controls supply of a voltage from a high voltage source (7) through a discharge needle (8) to any one or more of the ion sources (3-1 to 3-4). When the plurality of ion sources (3-1 to 3-4) operates, normal APCI is performed by an ion source that is close to a sample loading unit (1), and generated ions are discharged to the outside of the ion source by a discharge electrode (9). A residual neutral molecule that is not ionized is transferred by an extraction electrode (10) to an ion source located on the side of a mass spectrometer. Even when it is difficult for an ion source located at a single stage to detect a component, the component can be detected by a combination of the ion sources (3-1 to 3-4).

12 Claims, 4 Drawing Sheets

(56) References Cited

U.S. PATENT DOCUMENTS

| | | | | |
|---|---|---|---|---|
| 2004/0032211 | A1* | 2/2004 | Langford et al. | 315/111.31 |
| 2008/0290271 | A1* | 11/2008 | Togashi | 250/288 |
| 2009/0084950 | A1* | 4/2009 | Nagano et al. | 250/282 |

FOREIGN PATENT DOCUMENTS

| | | | |
|---|---|---|---|
| JP | 2005-353340 | A | 12/2005 |
| JP | 2005353340 | A * | 12/2005 |
| JP | 2008-26225 | A | 2/2008 |

OTHER PUBLICATIONS

Form PCT/ISA/237 (five (5) pages).

Notification of Transmittal of Translation of the International Preliminary Report on Patentability (Forms PCT/IB/338, PCT/IB/373, and PCT/ISA/237) (ten (10) pages).

* cited by examiner

FIG. 3

REACTANT ION $XH^+$ EXAMPLES : $(H_2O)H^+$, $CH_5^+$, $NH_4^+$

COMPONENT MOLECULE Mn (n=1,2····n)

(PROTON AFFINITIES OF REACTANT MOLECULES HAVE RELATIONSHIP OF M1 > M2 >····> Mn)

ION-MOLECULE REACTION PROCESS $$Mn + XH^+ \rightarrow MnH^+ + X$$

$$Mn - 1 + MnH^+ \rightarrow Mn - 1H^+ + Mn$$

$$\vdots$$

$$M1 + MnH^+ \rightarrow M1H^+ + Mn$$

COMBINATION OF OPERATING ION SOURCES AND DETECTED IONS

| | CHAMBER 1 | CHAMBER 2 | CHAMBER 3 | CHAMBER 4 | IONS INTRODUCED IN MS |
|---|---|---|---|---|---|
| NORMAL MODE | — | — | — | ON | M1H+>>M2H+>M3H+··· |
| TWO-STAGE IONIZATION MODE | — | — | ON | ON | M2H+>>M3H+>M4H+··· |
| THREE-STAGE IONIZATION MODE | — | ON | ON | ON | M3H+>>M4H+··· |
| FOUR-STAGE IONIZATION MODE | ON | ON | ON | ON | M4H+>····· |

MASS SPECTROMETRY DEVICE AND METHOD USING ION-MOLECULE REACTION IONIZATION

TECHNICAL FIELD

The present invention relates to a mass spectrometer and method which perform ionization using an ion-molecule reaction.

BACKGROUND ART

In the fields of environments, food, medicine and forensic medicine, mass spectrometry is often used as a method for obtaining qualitative/quantitative information on trace amounts (order of ppm to ppb) of multi-components with a high sensitivity.

To ionize component molecules for analysis using the mass spectrometry, various types of ionizing means are used in accordance with chemical characteristics.

The use of electron-impact ionization provides structural information. Soft ionization methods (such as atmospheric pressure ionization, chemical ionization, and electrospray ionization) involve selective generation of ions including information about molecular weight.

Samples are analyzed for various components that are to be detected in trace amounts, with the samples containing foreign components. Examples of such samples include controlled substances (such as residual agricultural chemicals in food and antibiotics), contaminated substances (agricultural substances, chemical substances and physiologically active substances) in environments, and medicines contained in biological components. It is, however, difficult to accurately perform qualitative/quantitative analysis using the aforementioned ionization methods since the foreign components (multi-components) make an adverse effect and analysis is hindered.

For the analysis of the sample containing the multi-components, a gas chromatogram mass spectrometer or a liquid chromatogram mass spectrometer is used to separate the sample into components and subject each of the components to qualitative/quantitative analysis.

When gas chromatograph mass spectrometry and liquid chromatograph mass spectrometry are used, however, it takes much time to complete the separation, and conditions for the separation and the analysis for each component are complex. As a result, it takes approximately 30 minutes to 1 hour to complete the analysis. Thus, quick analysis of many specimens is difficult.

Meanwhile, a selective soft ionization method is used to cause a specific ion to collide with He or the like in a mass spectrometer and thereby obtain structural information (MS/MS method).

Since MS/MS method has selectivity in the transfer of charges during soft ionization (especially, ion-molecule reaction), emphasis is on a component that has a high affinity (proton affinity) for charges. It is, therefore, problematic for simultaneous analysis.

To quickly achieve the simultaneous analysis, it is necessary to simultaneously load multi-components, extract their respective components as ions, and analyze each of the components.

Soft ionization is optimal as ionizing means but the following effect occurs. From the selectivity depending on the affinity for charges, the component having a high affinity for charges is sensitized while the component having a low affinity for charges is suppressed in sensitization. Under this effect, the selectivity depending on the affinity for charges prohibits the simultaneous analysis whereas an ion-molecule reaction effectively takes place, which indicates that the efficiency of the ionization is high.

Like in a technique described in Patent Document 1, an invention has been made which provides a mass spectrometer with a plurality of ion sources each different in ionization.

PRIOR ART DOCUMENT

Patent Document

Patent Document 1: JP-2005-353340-A

SUMMARY OF THE INVENTION

Problems to be Solved by the Invention

According to the technique described in Patent Document 1, however, the sample is distributed and introduced to the plurality of ion sources and the amount of the sample introduced in the associated ionizers is small accordingly.

As a result, detection sensitivity is expected to be reduced.

If a mass spectrometer is provided for each ion source, the size of an overall device will be provably increased.

An object of the present invention is to achieve a mass spectrometry device and method, which use ion-molecule reaction ionization and enable qualitative/quantitative analysis to be accurately performed on a sample containing multi-components for a short time without an increase in the size of the device.

Means for Solving the Problems

To accomplish the aforementioned object, the present invention is configured as follows.

In the mass spectrometer and method that use the ion-molecule ionization reaction ionization, a sample that contains a plurality of components is gasified, ion-molecule reaction is continuously performed on the gasified sample a plurality of times, ions that are obtained by the ionization performed the plurality of times are analyzed, and the sample is subjected to the qualitative/quantitative analysis on the basis of the analysis of the ions.

Effects of the Invention

According to the present invention, a mass spectrometer and method can be achieved, which use the ion-molecule reaction ionization and enable the qualitative/quantitative analysis to be accurately performed on a sample containing multi-components for a short time without an increase in the size of the device.

BRIEF DESCRIPTION OF THE DRAWINGS

FIG. 3 is a diagram illustrating a principle of ionization according to the present invention.

MODE FOR CARRYING OUT THE INVENTION

Hereinafter, an embodiment of the present invention is described with reference to accompanying drawings.

EMBODIMENT

Figure 1:
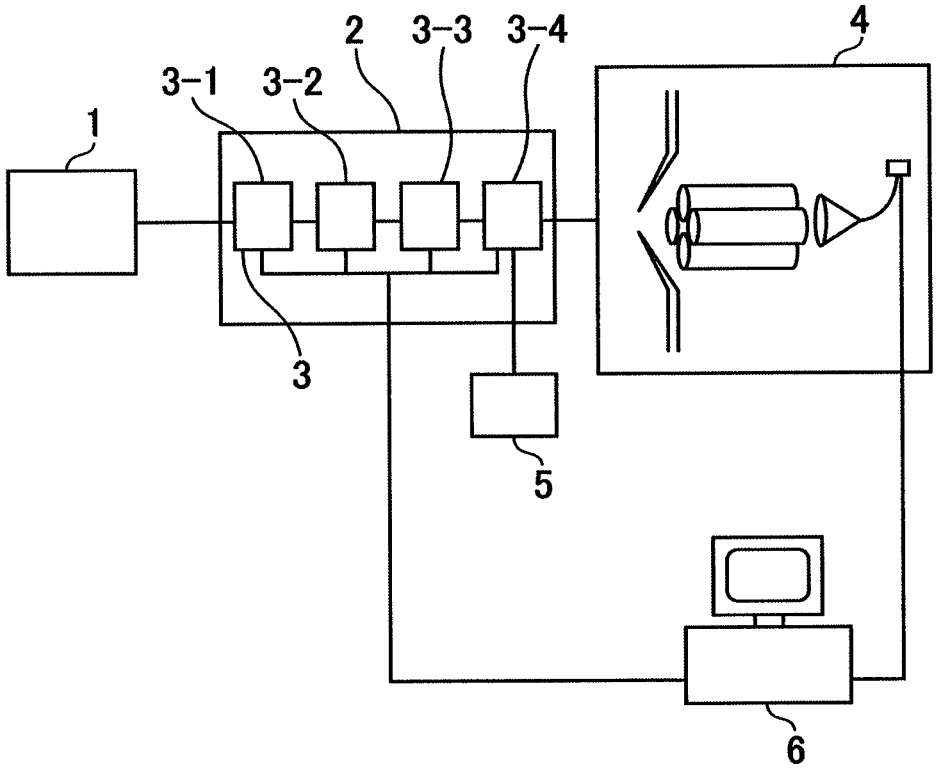
FIG. 1 is a diagram illustrating an outline configuration of a mass spectrometer according to an embodiment of the present invention.

FIG. 1 is a diagram illustrating an outline configuration of a mass spectrometer according to the embodiment of the present invention.

Referring to FIG. 1, a sample is loaded in a sample loading unit 1. Examples of the sample include a residual agricultural chemical contained in food, a contaminated organic substance contained in environmental water, and a drug contained in a biological fluid. The sample loading unit 1 is means for subjecting the sample to heating vaporization, liquid spraying, vaporization or the like and extracting the sample as gas. The sample gas is introduced from the sample loading unit 1 into an ionizer 2 for performing ion-molecule reaction.

Components of the sample gas that is introduced in the ionizer 2 are ionized by ion sources 3. In this case, the ion sources 3 are arranged in series in the ionizer 2 and perform the ion-molecule reaction such as atmospheric pressure chemical ionization (APCI).

Only ions are introduced from the ion sources 3 (3-1, 3-2, 3-3, 3-4) into a mass spectrometer 4 (MS). Then, the MS 4 analyzes the ions.

The sample gas that is not ionized in the ionizer 2 is discharged to the outside of the ionizer 2 through a discharge port 5.

In one embodiment according to the present invention, the MS 4 is illustrated as a quadrupole mass spectrometer. The MS 4, however, may be an ion trap mass spectrometer, a tandem quadrupole mass spectrometer, a time-of-flight mass spectrometer, or the like.

A controller/analyzer 6 has a display unit and controls the MS 4 and the ionizer 2 during measurement. The ionizer 2 includes the combination of the ion sources arranged at the multiple stages. Signals indicative of the ions that are analyzed by the MS 4 are transmitted to the controller/analyzer 6. The controller/analyzer 6 subjects the sample to qualitative/quantitative analysis.

In this case, different mass spectrums obtained by combinations of the ion sources 3 at the multiple stages can be analyzed as individual mass spectrums, and also can be analyzed as a whole image by integrating (averaging) them, or some specific components can be emphasized in the analysis by taking a difference between them.

Figure 2:
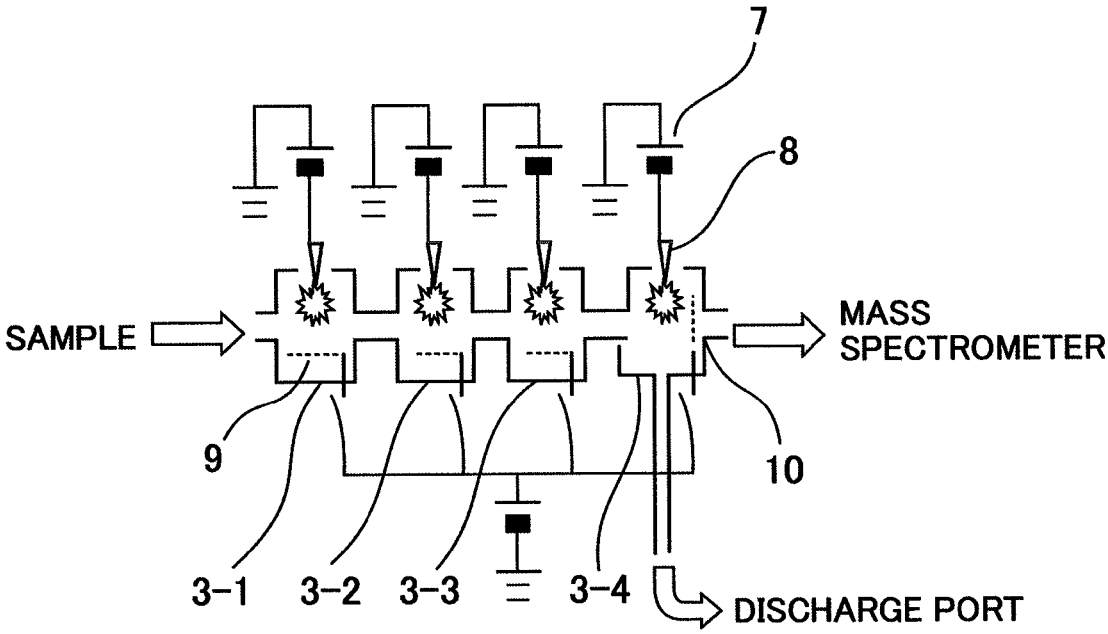
FIG. 2 is a diagram illustrating a configuration of an ionizer included in the mass spectrometer illustrated in FIG. 1.

FIG. 2 is a diagram illustrating multi-stage ionization that is performed by the ion sources 3 (3-1, 3-2, 3-3, 3-4) (illustrated in FIG. 1) arranged at the multiple stages.

FIG. 2 illustrates the ion-molecule reaction to be performed at the four stages and illustrates that the ionization is atmospheric pressure chemical ionization (APCI) as an example. The same effects can be obtained by other ionization (chemical ionization, penning ionization) as long as the ion-molecule reaction is used as a principle in the ionization. In one embodiment according to the present invention, the basis for the sample gas is an atmosphere.

The ion sources 3-1 to 3-4 include discharge needles 8, respectively. A high voltage source 7 applies a voltage of 3 to 5 kV to the discharge needle 8. Reactant ions are generated due to corona discharge of the atmosphere in the ion sources 3-1 to 3-4. When a main component is the atmosphere, and a cation is to be analyzed as a reactant ion that represents the starting point of the ion-molecule reaction, a molecule $H_2OH^+$ (generally, $(H_2O)nH^+$) obtained by adding a proton to a water molecule is effective.

Under the atmosphere, the reactant ion frequently collides with molecules of the sample components. Since the molecules of the components of the sample generally have high (proton) affinities for charges, a migration reaction (illustrated in FIG. 3) of a proton occurs due to the collision. In the reaction, a charge preferentially migrates to a component that has the highest affinity for charges among molecules of components existing in an ionized atmosphere.

The controller/analyzer 6 provides a command signal to control an operation to cause the high voltage source 7 to apply the voltage to any one or more of the ion sources 3-1 to 3-4, that is, drive the any one or more of the ion sources 3-1 to 3-4.

In one embodiment according to the present invention, when the high voltage is supplied to only the ion source 3-4 provided at a position closest to the MS 4, a mass spectrum can be obtained that is the same as a mass spectrum obtained by a device that performs normal APCI.

When two stages (for example, 3-3 and 3-4) of the ion sources operate, the aforementioned normal APCI is performed in the ion source (for example, 3-3) that is closer to the sample loading unit 1. Ions generated by this ion source (for example, 3-3) are discharged by a discharge electrode 9 to the outside of the ion source.

A component that is ionized preferentially and has a high affinity for charges is removed. A residual neutral molecule that is not ionized is transferred by an extraction electrode 10 to the ion source (for example, 3-4) located on the side of the MS 4. The ion source 3-4 that is closest to the mass spectrometer 4 among the plurality of ion sources 3-1 to 3-4 discharges generated ions into the mass spectrometer 4.

Water molecules that are the basic substances of reactant ions excessively exist. Thus, a large amount of water molecules exist in the residual neutral molecules and a large amount of reactant ions can be generated in the second-stage ionization (for example, ionization performed in the ion source 3-4). An ion with a low affinity for charges is generated in the second-stage ionization (3-4) with a higher probability, compared with the first-stage ionization (3-3).

Thus, the mass spectrum detected by the MS 4 is a spectrum in which emphasis is on a component having a low affinity for charges. By repeating this operation a plurality of times, a component difficult to detect with the use of only one ion source can be detected when the ion sources 3-1 to 3-4 are used in combination at the stages.

At each stage of the ion sources 3-1 to 3-4, a component having a low affinity for charges is sensitized, compared with a component with a high affinity for charges. Thus, it can be appreciated that the total amount of detectable ions will be increased. As illustrated in FIG. 3, for a single measurement of the sample, mass spectrums are measured when the ion sources is changed in combination so that the ionization is performed at one stage, two stages, three stages and four stages, and respective spectrums are integrated. This makes it possible to analyze a whole mass spectrum sensitized. The controller/analyzer 6 executes such integration and analysis.

On the other hand, it is difficult to eliminate all ions from each of the ion sources, and it seems that a spectrum of a component having a high affinity for charges becomes a spectrum of residual components.

Figure 4:
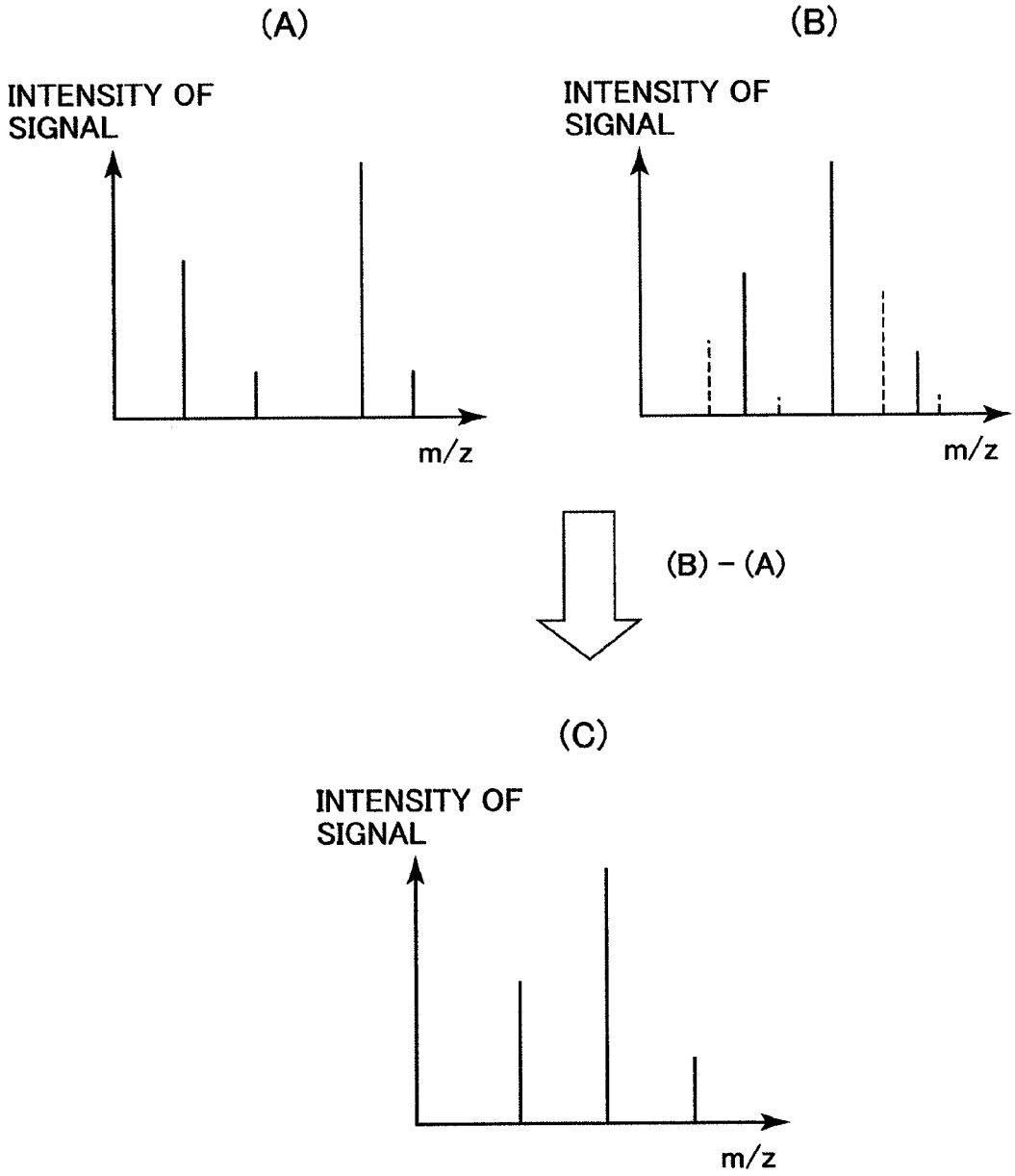
FIG. 4 is a diagram explaining an integration and subtraction process that is performed on mass spectrum data obtained in the embodiment of the present invention.

As illustrated in FIG. 4, spectrum data (A) is spectrum data obtained by the first-stage ionizing unit of the ionizer 3, while spectrum data (B) is spectrum data obtained by the second-stage ionizing unit of the ionizer 3.

A spectrum included in the spectrum data (B) and indicated by a dotted line is the same as spectrum data of ions detected from the spectrum data (A). Only ion species, which are generated during the ionization performed by the second-stage ionizing unit, can be specifically extracted by subtracting the spectrum data (A) obtained from the first stage from the spectrum data (B) obtained by the second-stage ionizing unit during data processing performed by the data controller/analyzer 6.

Signals indicative of a component having a low affinity for charges can be emphasized by calculating a difference between different spectrums obtained by combinations of any one or more of the ion sources 3-1 to 3-4, and information that is useful for the analysis can be obtained like spectrum data (C) illustrated in FIG. 4.

The spectrum data (A) to (C) illustrated in FIG. 4 can be displayed on the display unit of the controller/analyzer 6.

The combination of any one or more of the ion sources 3-1 to 3-4 can be changed at times (for example, per time unit of several tens of seconds) for the analysis on the basis of the amount of a solution contained in the sample. In the embodiment of the present invention, if the ion sources 3-1 to 3-4 are arranged at the four stages, four ionization modes are provided, which are a normal mode (in which the ion source 3-4 is turned on), a two-stage ionization mode (in which the ion sources 3-3 and 3-4 are turned on), a three-stage ionization mode (in which the ion sources 3-2, 3-3 and 3-4 are turned on) and a four-stage ionization mode (in which ion sources 3-1, 3-2, 3-3 and 3-4 are turned on). Thus, the analysis is completed within approximately several minutes.

In addition, the combination of any one or more of the ion sources 3-1 to 3-4 may be changed when a peak that is equal to or higher than a certain value is detected by the MS 4.

According to the embodiment of the present invention, the plurality of the ionizing units (3-1, 3-2, 3-3 and 3-4) are arranged in series and connected to each other. By switching the application of the voltage to the ionizing units 3-1 to 3-4, the ion-molecule reaction is continuously performed on the same sample gas a plurality of times. The mass spectrometry device and method, which use the ion-molecule reaction ionization and enable the qualitative/quantitative analysis to be accurately performed on a mass spectrum of a plurality of molecules having different affinities for charges for a short time without an increase in the size of the device.

In the aforementioned embodiment, the number of the stages of the ion sources is four, such as the ion sources 3-1 to 3-4. Ion sources may be arranged at two stages, three stages, four stages, five stages, six stages or the like as long as the ion sources are arranged at a plurality of stages. The number of stages at which the ion sources are arranged is not limited.

In addition, the embodiment describes that the ion sources are mechanically connected in series. The same effects, however, can be obtained when the introduced sample gas is confined in any (preferably, the ion source 3-4) of the ion sources of the ionizer 2, and the controller/analyzer 6 temporally switches the application of the voltage for each of the stages for the ionization a plurality of times and thereby controls the ionization.

DESCRIPTION OF REFERENCE NUMERALS

1: Sample loading unit
2: Ionizer
3 (3-1, 3-2, 3-3, 3-4): Ion source
4: Mass spectrometer
5: Discharge port
6: Controller/analyzer
7: High voltage source
8: Discharge needle
9: Discharge electrode
10: Extraction electrode

The invention claimed is:

1. A mass spectrometer that uses ion-molecule reaction ionization, comprising:

a sample loading unit in which to load a sample containing a plurality of components, the sample loading unit adapted to gasify the loaded sample;

an ionizer to which the gasified sample is introduced from the sample loading unit, the ionizer adapted to continuously perform the ion-molecule reaction on the introduced sample a plurality of times;

a single mass spectrometer for analyzing ions introduced from the ionizer; and a controller/analyzer that controls the operation of the ionizer and subjects the sample to qualitative/quantitative analysis on the basis of the ion analysis by the mass spectrometer, wherein the ionizer comprises a plurality of ion sources arranged in series with an outlet leading to the single mass spectrometer, wherein each of the ion sources comprises a respective ion chamber and a respective discharge needle, wherein each of adjacent ion chambers are connected by a respective connection part having a cross-sectional area that is smaller than a cross-sectional area of the adjacent ion chambers in a same plane, wherein residual neutral molecules that are not ionized are transferred from the first one of the ion sources to a second one of the ion sources through a respective connection part, and wherein the controller/analyzer performs control on a judgment as to which one or more of the ion sources is to be driven.

2. The mass spectrometer according to claim 1, wherein the plurality of ion sources discharge generated ions to the outside of the ion sources, and wherein a particular ion source of the plurality of the ion sources discharges generated ions to the mass spectrometer, the particular ion source being provided at a position closest to the mass spectrometer.

3. The mass spectrometer according to claim 1, wherein the controller/analyzer performs a process of integrating mass spectrums obtained by a combination of the driven ion sources among the plurality of ion sources and calculating a difference between the mass spectrums.

4. The mass spectrometer according to claim 1, wherein the controller/analyzer causes the ionizer to perform the ion-molecule reaction on the same sample gas and discharge generated ions a plurality of times, and cause the generated ions to be introduced into the mass spectrometer.

5. The mass spectrometer according to claim 4, wherein the controller/analyzer causes the ionizer to perform the ion-molecule reaction on the same sample gas and discharge generated ions a plurality of times, and performs a process of integrating mass spectrums generated by the ion-molecule reaction performed the plurality of times and calculating a difference between the mass spectrums.

6. A mass spectrometry method using ion-molecule reaction ionization, comprising the steps of:

gasifying a sample that contains a plurality of components;

continuously performing the ion-molecule reaction on the gasified sample a plurality of times, wherein the performing of the ion-molecule reaction comprises:

generating ions by a first one of a plurality of ion sources arranged in series with an outlet leading to a single mass spectrometer; and transferring residual neutral molecules that are not ionized from the first one of the ion sources to a second one of the ion sources through a connection part between the first one of the ion sources and the second one of the ion sources;

analyzing ions generated in the ion-molecule reaction performed the plurality of times;

subjecting the sample to qualitative/quantitative analysis on the basis of the ion analysis; and performing control on a judgment as to which one or more of the ion sources is to be driven.

7. The mass spectrometry method according to claim 6, wherein ions that are generated by the plurality of ion sources are discharged to the outside of the ion sources, and wherein ions that are generated by causing an ion source among the plurality of ion sources to finally ionize the sample are analyzed.

8. The mass spectrometry method according to claim 6, further comprising the step of performing a process of integrating mass spectrums obtained by a combination of the driven ion sources among the plurality of ion sources and calculating a difference between the mass spectrums.

9. The mass spectrometry method according to claim 6, wherein the ion-molecule reaction of the sample gas and discharge of the generated ions are performed a plurality of times, and wherein mass spectrometry is performed on the generated ions.

10. The mass spectrometry method according to claim 9, wherein the ion-molecule reaction of the same sample gas and the discharge of the generated ions are performed a plurality of times, and wherein a process of integrating mass spectrums generated by the ion-molecule reaction performed the plurality of times and calculating a difference between the mass spectrums is performed.

11. The mass spectrometer according to claim 1, wherein the residual neutral molecules are ionized by the second one of the ion sources and transferred from the second one of the ion sources to the mass spectrometer to be analyzed.

12. The mass spectrometry according to claim 6, wherein the performing of the ion-molecule reaction further comprises ionizing the residual neutral molecules by the second one of the ion sources, and wherein the ionized residual neutral molecules are analyzed.

* * * * *